US008899706B2

(12) United States Patent
Yabuki

(10) Patent No.: US 8,899,706 B2
(45) Date of Patent: Dec. 2, 2014

(54) RECORDING APPARATUS

(75) Inventor: Tomoyasu Yabuki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 115 days.

(21) Appl. No.: 13/434,357

(22) Filed: Mar. 29, 2012

(65) Prior Publication Data

US 2012/0249629 A1 Oct. 4, 2012

(30) Foreign Application Priority Data

Mar. 31, 2011 (JP) ..... 2011-078614

(51) Int. Cl.
*B41J 29/38* (2006.01)
*B41J 2/175* (2006.01)
*B41J 29/13* (2006.01)

(52) U.S. Cl.
CPC ..... *B41J 2/1752* (2013.01); *B41J 29/38* (2013.01); *B41J 29/13* (2013.01)
USPC ..... 347/6

(58) Field of Classification Search
CPC ..... B41J 29/38
USPC ..... 347/6
See application file for complete search history.

(56) References Cited

U.S. PATENT DOCUMENTS 6,419,411 B1 7/2002 Tanno
2005/0062793 A1 3/2005 Takagi et al.
2008/0123126 A1 5/2008 Harris
2008/0158313 A1* 7/2008 Silverbrook et al. ..... 347/85
2012/0105524 A1 5/2012 Yamamoto
2012/0251166 A1 10/2012 Yamamoto et al.

FOREIGN PATENT DOCUMENTS

EP 0598701 A2 5/1994
JP S58-116182 A 7/1983
JP S60-172575 A 9/1985
JP S63-254044 A 10/1988
JP H05-131720 A 5/1993
JP 2000-095374 A 4/2000
JP 2004-345307 A 12/2004
JP 2005-088209 A 4/2005

(Continued)

OTHER PUBLICATIONS

European Patent Office, extended European Search Report for European Patent Application No. 11187031.7 (counterpart to co-pending U.S. Appl. No. 13/284,664), dated Feb. 7, 2012.

*Primary Examiner* — Alessandro Amari
*Assistant Examiner* — Alexander C Witkowski
(74) *Attorney, Agent, or Firm* — Baker Botts L.L.P.

(57) ABSTRACT

A recording apparatus, including: a tank mount on which a tank is mountable; a first casing; a second casing provided with the tank mount, connected to the first casing with a shaft, and pivotable between a close position and a distant position about the shaft; a judging section configured to judge whether a tank mount state is a middle-of-mounting state; a limitation portion configured to establish a limitation state for limiting the pivotal movement of the second casing at the close position and a release state for allowing the pivotal movement at the close position; and a limitation control section configured to control the limitation portion to establish the limitation state when the tank is in the middle-of-mounting state, and control the limitation portion to establish the release state when the tank is not in the middle-of-mounting state.

10 Claims, 11 Drawing Sheets

(56) References Cited

FOREIGN PATENT DOCUMENTS

| | | | |
|---|---|---|---|
| JP | 2005-096187 | A | 4/2005 |
| JP | 2006-044128 | A | 2/2006 |
| JP | 2006-142608 | A | 6/2006 |
| JP | 2009-072931 | A | 4/2009 |
| WO | 01/89836 | A1 | 11/2001 |

* cited by examiner

<EMPTY STATE A>

<EMPTY STATE B>

<PARTIALLY MOUNTED STATE>

<COMPLETELY MOUNTED STATE A>

<COMPLETELY MOUNTED STATE B>

FIG.8

| PRINTER STATE | A1 | A2 | A3 | A4 | A5 | A6 | A7 | A8 | A9 | A10 |
|---|---|---|---|---|---|---|---|---|---|---|
| TANK MOUNT STATE | EMPTY STATE | | PARTIALLY | COMPLETELY MOUNTED | | EMPTY STATE | | PARTIALLY | COMPLETELY MOUNTED | |
| UPPER CASING SENSOR | ON | ON | ON | ON | ON | OFF | OFF | OFF | OFF | OFF |
| COVER SENSOR | ON | OFF | OFF | OFF | ON | ON | OFF | OFF | OFF | ON |
| TANK BOTTOM SENSOR | OFF | OFF | OFF | ON | ON | OFF | OFF | OFF | ON | ON |
| LOCK MECHANISM | RELEASE | LIMITATION | | RELEASE | | | | | | |

PARTIALLY: PARTIALLY MOUNTED STATE
COMPLETELY MOUNTED: COMPLETELY MOUNTED STATE
ON: DETECTION SIGNAL OUTPUTTED
OFF: NO DETECTION SIGNAL OUTPUTTED
RELEASE: RELEASE STATE
LIMITATION: LIMITATION STATE

FIG.10A

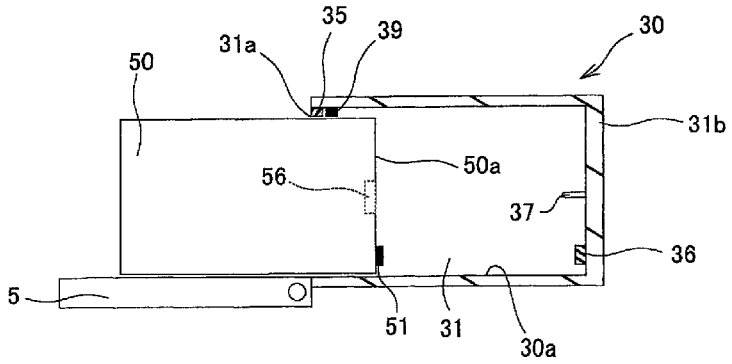

FIG.10B

| PRINTER STATE | A1 | A2 | A3 | A4 | A5 | A6 | A7 | A8 | A9 | A10 |
|---|---|---|---|---|---|---|---|---|---|---|
| TANK MOUNT STATE | EMPTY STATE | | PARTIALLY | COMPLETELY MOUNTED | | EMPTY STATE | | PARTIALLY | COMPLETELY MOUNTED | |
| UPPER CASING SENSOR | ON | ON | ON | ON | ON | OFF | OFF | OFF | OFF | OFF |
| COVER SENSOR | ON | OFF | OFF | OFF | ON | ON | OFF | OFF | OFF | ON |
| TANK BOTTOM SENSOR | OFF | OFF | OFF | ON | ON | OFF | OFF | OFF | ON | ON |
| TANK-INSERTION-END SENSOR | OFF | OFF | ON | ON | ON | OFF | OFF | ON | ON | ON |
| LOCK MECHANISM | RELEASE | | LIMITATION | RELEASE | | | | | | |

FIG.10C

| PRINTER STATE | A1 | A2 | A3 | A4 | A5 | A6 | A7 | A8 | A9 | A10 |
|---|---|---|---|---|---|---|---|---|---|---|
| TANK MOUNT STATE | EMPTY STATE | | PARTIALLY | COMPLETELY MOUNTED | | EMPTY STATE | | PARTIALLY | COMPLETELY MOUNTED | |
| UPPER CASING SENSOR | ON | ON | ON | ON | ON | OFF | OFF | OFF | OFF | OFF |
| TANK BOTTOM SENSOR | OFF | OFF | OFF | ON | ON | OFF | OFF | OFF | ON | ON |
| TANK-INSERTION-END SENSOR | OFF | OFF | ON | ON | ON | OFF | OFF | ON | ON | ON |
| LOCK MECHANISM | RELEASE | | LIMITATION | RELEASE | | | | | | |

RECORDING APPARATUS

CROSS REFERENCE TO RELATED APPLICATION

The present application claims priority from Japanese Patent Application No. 2011-078614, which was filed on Mar. 31, 2011, the disclosure of which is herein incorporated by reference in its entirety.

BACKGROUND OF THE INVENTION

1. Field of the Invention

The present invention relates to a recording apparatus configured to record an image on a recording medium.

2. Description of the Related Art

There is known a recording apparatus including a tank mount portion on which is mountable a tank storing recording agent for recording an image on a recording medium. This recording apparatus includes (i) a lower first casing provided with the tank mount portion and (ii) an upper second casing pivotable upward with respect to the first casing so as to be located at a close position close to the first casing and a distant position farther from the first casing than the close position.

SUMMARY OF THE INVENTION

The inventor of the present invention has examined to provide the tank mount portion in the second casing in the above-described recording apparatus and found the following problems. That is, when the user pivots the second casing for a purpose different from mount or removal of the tank (e.g., a maintenance operation for an inside of the apparatus) in a state in which the tank is being mounted on the tank mount portion (for example, in a case where the tank exists in the tank mount portion but is not completely mounted), the tank moves in the tank mount portion with the pivotal movement of the second casing. As a result, the tank may drop off the tank mount portion, or the tank and the tank mount portion may collide with each other, resulting in damages to the tank and/or the tank mount portion.

This invention has been developed to provide a recording apparatus capable of suppressing damages to a tank and a tank mount portion.

The present invention provides a recording apparatus, including: a tank mount portion on which a tank storing a recording agent for recording an image on a recording medium is mountable; a first casing; a second casing connected to the first casing with a shaft and pivotable about the shaft with respect to the first casing in a pivotal direction having a vertical component so as to be located at (i) a close position which is close to the first casing and at which the image is recorded on the recording medium and (ii) a distant position farther from the first casing than the close position, the second casing being provided with the tank mount portion; a judging section configured to judge whether a tank mount state that is a mount state of the tank with respect to the tank mount portion is a middle-of-mounting state in which the tank is being mounted on the tank mount portion; a limitation portion configured to establish a limitation state for limiting the pivotal movement of the second casing located at the close position and a release state for allowing the pivotal movement of the second casing located at the close position; and a limitation control section configured to control the limitation portion to establish the limitation state when the judging section judges that the tank is in the middle-of-mounting state, and configured to control the limitation portion to establish the release state when the judging section judges that the tank is not in the middle-of-mounting state.

The present invention provides a recording apparatus, including: a tank mount portion on which a tank storing a recording agent for recording an image on a recording medium is mountable; a first casing; a second casing connected to the first casing with a shaft and pivotable about the shaft with respect to the first casing in a pivotal direction having a vertical component so as to be located at (i) a close position which is close to the first casing and at which the image is recorded on the recording medium and (ii) a distant position farther from the first casing than the close position, the second casing being provided with the tank mount portion; a judging section configured to judge whether the tank is mounted on a mount position of the tank mount portion; a limitation portion configured to establish a limitation state for limiting the pivotal movement of the second casing located at the close position and a release state for allowing the pivotal movement of the second casing located at the close position; and a limitation control section configured to control the limitation portion to establish the limitation state when the judging section judges that the tank is not mounted on the mount position of the tank mount portion, and configured to control the limitation portion to establish the release state when the judging section judges that the tank is mounted on the mount position of the tank mount portion.

BRIEF DESCRIPTION OF THE DRAWINGS

The objects, features, advantages, and technical and industrial significance of the present invention will be better understood by reading the following detailed description of the embodiments of the invention, when considered in connection with the accompanying drawings, in which:

FIGS. 3A-3C are views for explaining a tank mount portion and a cartridge, wherein FIG. 3A is a cross-sectional view of a part of the printer when an upper casing is located at a close position, FIG. 3B is a cross-sectional view of the part of the printer when the upper casing is located at a distant position, and FIG. 3C is a front elevational view of the tank mount portion;

FIGS. 5A-5E are views for explaining a mount state of the cartridge with respect to the tank mount portion, wherein FIGS. 5A and 5B are cross-sectional views showing an empty state, FIG. 5C is a cross-sectional view showing a partially mounted state, and FIGS. 5D and 5E are cross-sectional views showing a completely mounted state;

FIG. 8 is a table showing: the tank mount state; a presence or absence of a detection signal from each of an upper casing sensor, a cover sensor, and a tank bottom sensor; and a state of the lock mechanism in each state of the printer shown in FIG. 7;

FIGS. 10A-10C are views for explaining an ink-jet printer as a second embodiment to which the present invention is applied, wherein FIG. 10A is a cross-sectional view of the tank mount portion and the cartridge, FIG. 10B is a table corresponding to that in FIG. 7, and FIG. 10C is a table in a modification of the second embodiment which corresponds to that in FIG. 7.

DETAILED DESCRIPTION OF THE EMBODIMENTS

Hereinafter, there will be described embodiments of the present invention by reference to the drawings.

First Embodiment

First, there will be explained an overall construction of an ink-jet printer 1 as one embodiment of a recording apparatus to which the present invention is applied, with reference to FIGS. 1-3C.

Figure 1:
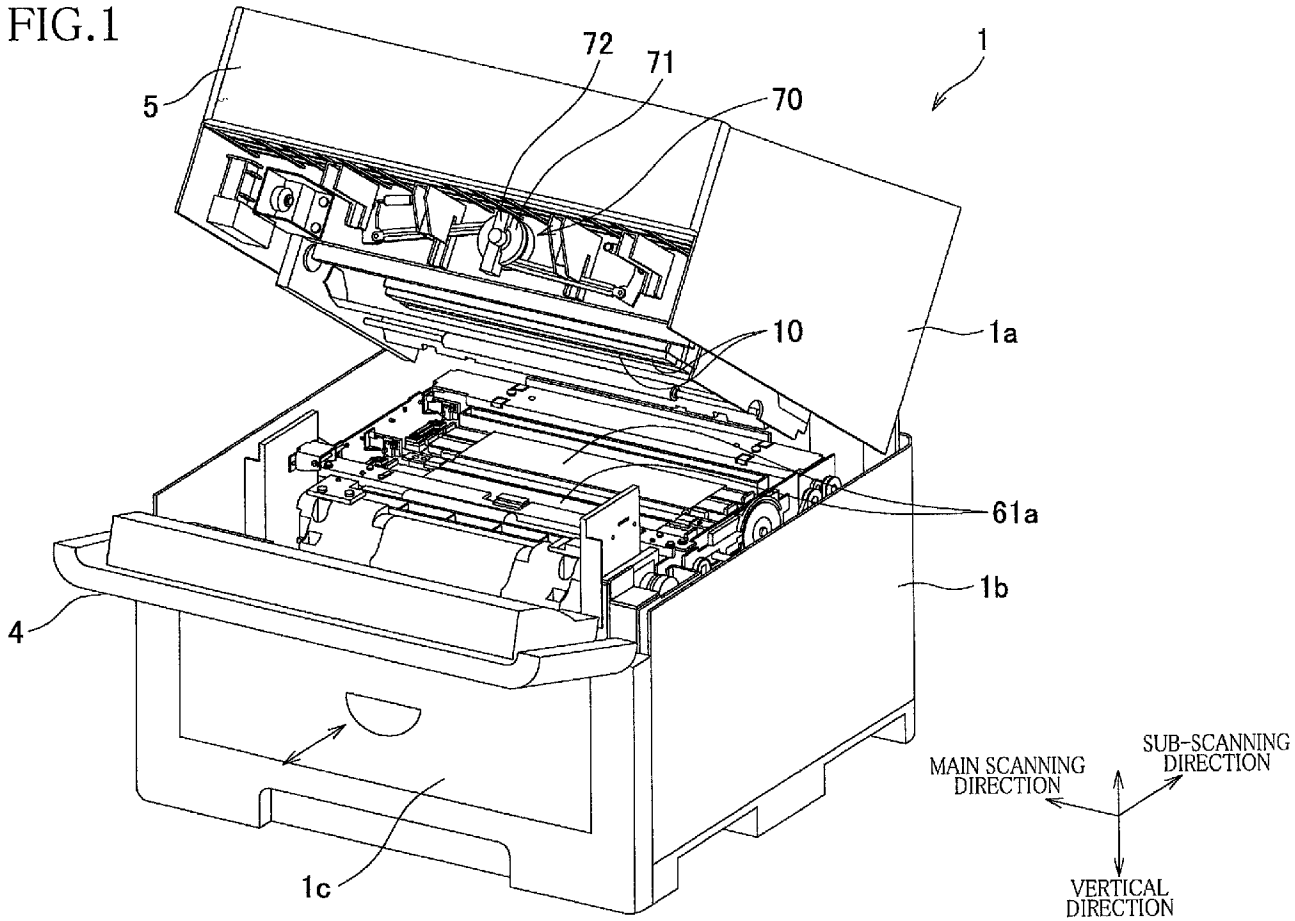
FIG. 1 is an external perspective view showing an ink-jet printer as a first embodiment to which the present invention is applied.
Figure 2:
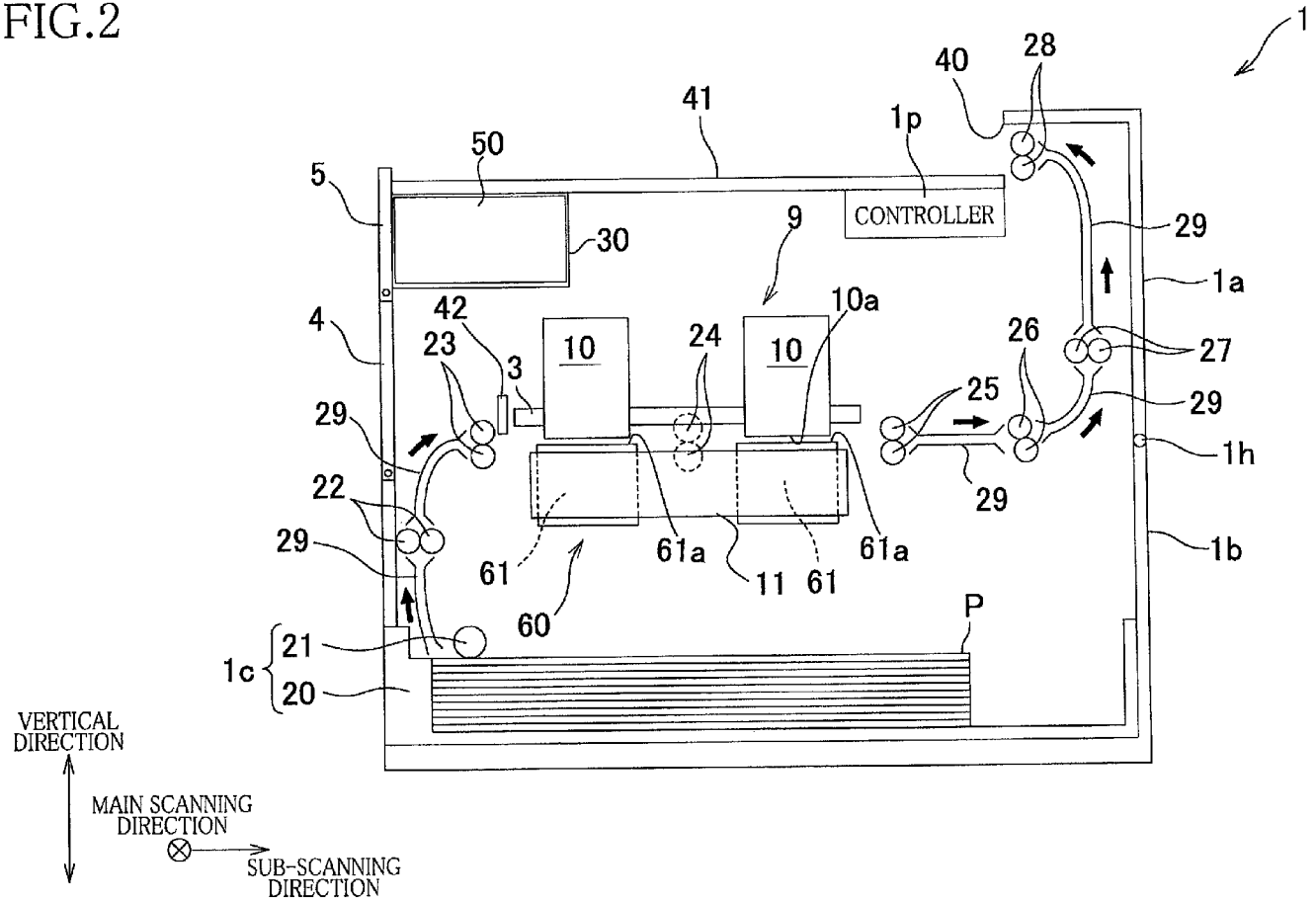
FIG. 2 is a side view generally showing an inside of the printer.

The printer 1 includes an upper casing 1*a* (as one example of a second casing) and a lower casing 1*b* (as one example of a first casing) each having a rectangular parallelepiped shape and having generally the same area as each other in a horizontal direction. The upper casing 1*a* opens in its lower face, and the lower casing 1*b* opens in its upper face. As shown in FIG. 2, when the upper casing 1*a* is superposed on the lower casing 1*b* so as to seal the opening faces of the casings 1*a*, 1*b*, a space in the printer 1 is defined. A sheet-discharge portion 41 is provided on a top plate of the upper casing 1*a*. In the space defined by the upper and lower casings 1*a*, 1*b* is formed a sheet conveyance path through which a recording medium in the form of a sheet P is conveyed from a sheet-supply unit 1*c* which will be described below toward the sheet-discharge portion 41 along bold arrows shown in FIG. 2.

As shown in FIG. 2, the upper casing 1*a* is connected to the lower casing 1*b* with a shaft 1*h* provided at a lower back edge of the upper casing 1*a* so as to extend in a main scanning direction. The upper casing 1*a* is pivotable about the shaft 1*h* with respect to the lower casing 1*b* in a direction having a vertical component. In other words, the shaft 1*h* as a pivotal shaft extends generally in the horizontal direction, and the upper casing 1*a* is pivotable about the shaft 1*h* with respect to the lower casing 1*b*. The upper casing 1*a* is pivotable so as to be positioned at (a) a close position at which the upper casing 1*a* is close to or contacts the lower casing 1*b* (e.g., a position shown in FIG. 2) and (b) a distant position (e.g., a position shown in FIG. 1) farther from the lower casing 1*b* than the close position. When the upper casing 1*a* is located at the distant position, the sheet conveyance path defined by the upper casing 1*a* located at the close position and the lower casing 1*b* is partially exposed, so as to form a work space on an upper side of the sheet conveyance path for a user. When the work space has been formed with the upper casing 1*a* being located at the distant position, the user can perform a jamming resolving operation and a maintenance operation for maintaining a recording portion 9 and a support portion 60. The jamming resolving operation is an operation performed by the user to remove a sheet P jammed in the sheet conveyance path during the recording operation. The maintenance operation for the recording portion 9 includes operations performed by the user to remove foreign matters attached to ejection faces 10*a*, to adjust positions of heads 10, and to replace the head 10, for example. The maintenance operation for the support portion 60 includes operations performed by the user to remove foreign matters attached to support faces 61*a*, to adjust a position of the support portion 60, and to replace the support portion 60, for example. The maintenance operation includes not only the maintenance operation for the recording portion 9 and the support portion 60 but also operations for cleaning or replacing components accommodated in the upper casing 1*a* and the lower casing 1*b* (e.g., a sheet-supply roller 21, guides 29, and a conveyance roller pairs 22-28).

Springs, not shown, are provided on the shaft 1*h* for urging the upper casing 1*a* in a direction in which the upper casing 1*a* is opened (i.e., in a direction from the close position toward the distant position). In the present embodiment, the upper casing 1*a* can be opened up to about 35 degrees with respect to a horizontal plane. It is noted that the distant position of the upper casing 1*a* is not limited to a position shown in FIG. 1. The upper casing 1*a* can be considered to be located at the distant position when the upper casing 1*a* is located at a position different from the close position and farther from the lower casing 1*b* than the close position.

Figure 6:
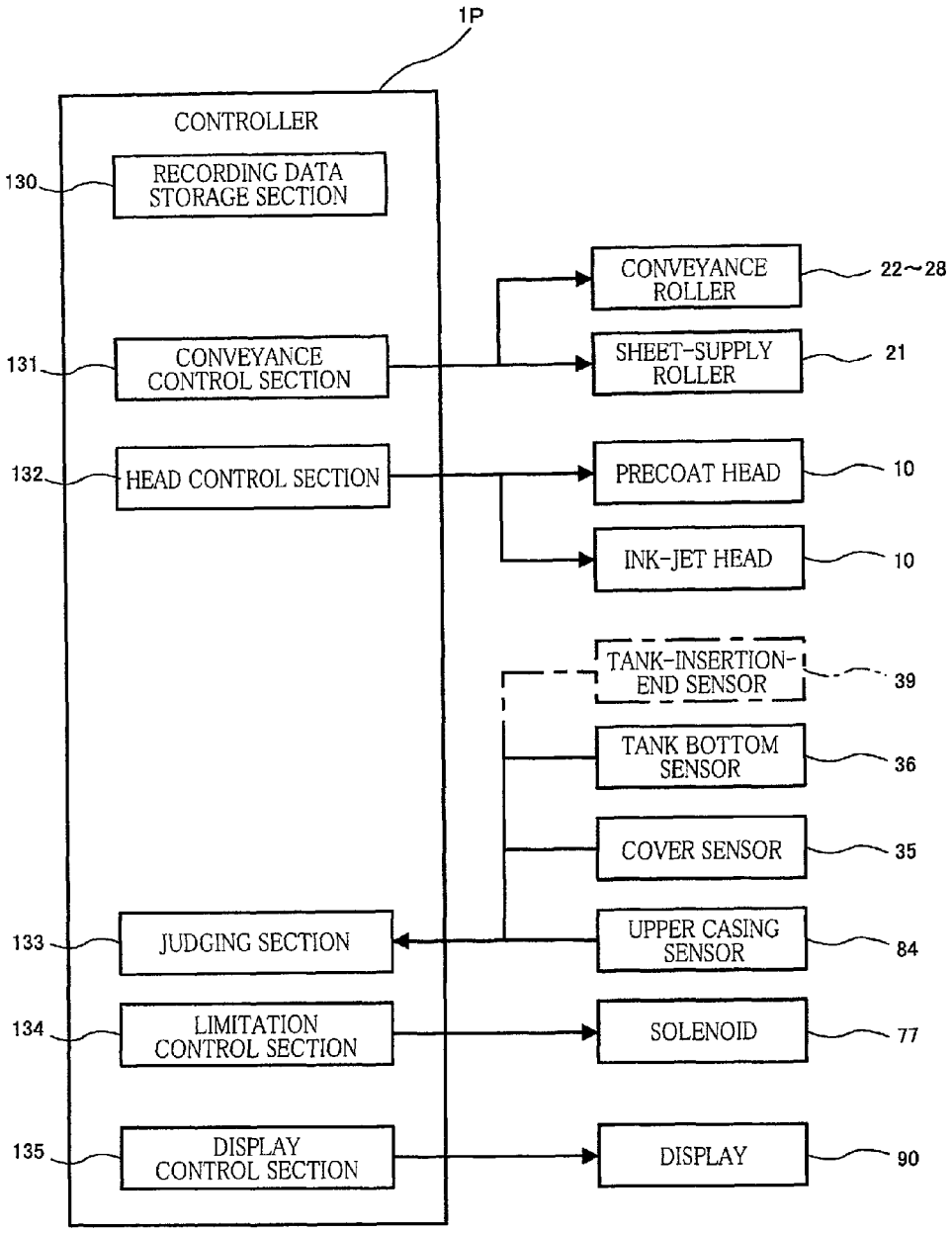
FIG. 6 is a functional block diagram of a controller.

The upper casing 1*a* accommodates: the two heads 10 (namely, a precoat head 10 configured to eject treatment liquid and an ink-jet head 10 configured to eject black ink in order from an upstream side in a sheet conveyance direction indicated by the bold arrows in FIG. 2); a frame 3 supporting the two heads 10 and an upper roller of the conveyance roller pair 24; two tank mount portions 30 on which cartridges 50 are respectively mountable; a controller 1*p* configured to control operations of the components of the printer 1; and a display 90 (see FIG. 6). In the present embodiment, the two heads 10 and the frame 3 constitutes the recording portion 9 for recording an image or a text on the sheet P. The two heads 10 are supported by the upper casing 1*a* via the frame 3.

As shown in FIG. 3, on the lower face of the upper casing 1*a* is provided an upper casing sensor 84 for outputting a detection signal to the controller 1*p* only when the upper casing 1*a* is located at the close position. The controller 1*p* judges whether the upper casing 1*a* is located at the distant position or the close position on the basis of the presence or absence of the detection signal outputted from the upper casing sensor 84.

In a front portion of the upper casing 1*a* (i.e., a front left portion thereof in a sheet of FIG. 1), there are provided: a lock mechanism (as one example of a limitation portion) 70 for limiting or restraining the pivotal movement of the upper casing 1*a* located at the close position; and a tank cover (as one example of a door) 5 for opening or closing openings 31*a* (which will be described below) of the respective tank mount portions 30. The tank mount portions 30 and the lock mechanism 70 will be explained in detail.

The upper casing 1*a* further accommodates: upper rollers of the conveyance roller pairs 25, 26; an upper guide of the guide 29 between these roller pairs 25, 26; the conveyance roller pairs 27, 28; and two pairs of the guides 29 between the conveyance roller pairs 26, 28 in the sheet conveyance direction. That is, when the upper casing 1*a* is pivoted upward from the close position to the distant position, all the components accommodated in the upper casing 1*a* are moved together with the upper casing 1*a*. It is noted that FIG. 2 partially omits illustrations of the components accommodated in the upper casing 1*a*.

The lower casing 1*b* accommodates the support portion 60 and the sheet-supply unit 1*c*. The lower casing 1*b* further accommodates a sheet sensor 42, the conveyance roller pairs 22, 23, and two pairs of the guides 29 between the sheet-supply unit 1*c* and the conveyance roller pair 23 in the sheet conveyance direction. On an upper front portion of the lower casing 1*b* is provided a pivotable cover 4 for covering the lock mechanism 70 in the upper casing 1*a*. When the cover 4 is open, the lock mechanism 70 is exposed.

Each of the cartridges (each as one example of a tank) 50 stores therein a corresponding one of the treatment liquid and black ink (hereinafter may be collectively referred to as "liquid") as liquid agent to be supplied to a corresponding one of the heads 10. The treatment liquid is liquid having a property of preventing spread and strike-through of the ink and a property of improving color development and quick drying of the ink, for example.

Figure 3A:
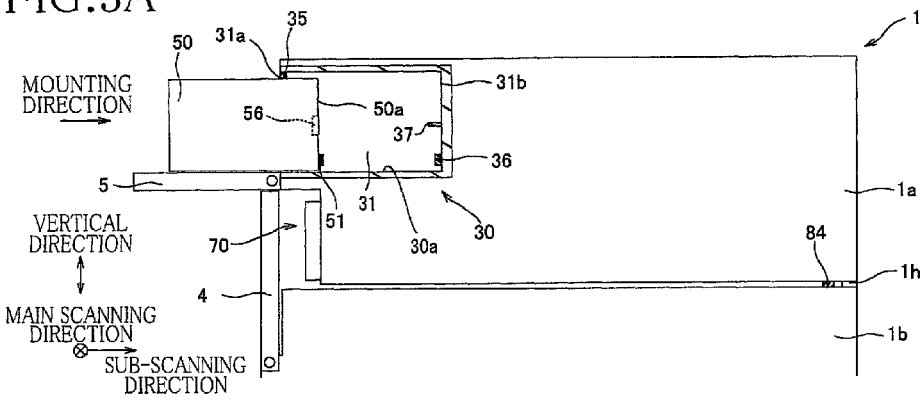
Figure 3B:
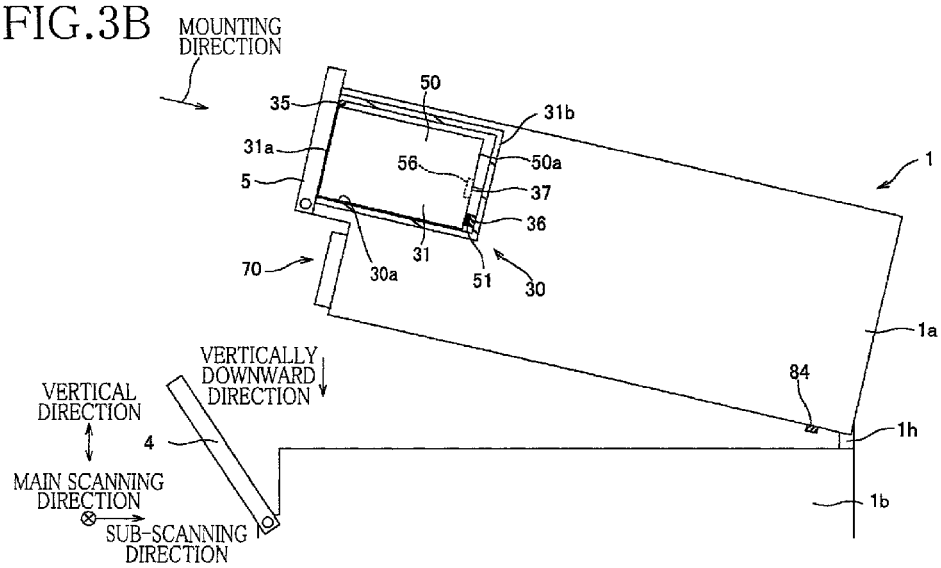

As shown in FIGS. 3A and 3B, each cartridge 50 has a generally rectangular parallelepiped shape as its outer shape. The cartridge 50 has a front face 50*a* as a downstream face of the cartridges 50 in a direction in which the cartridge 50 is inserted into or mounted on the corresponding tank mount portion 30 (hereinafter may be referred to as "cartridge mounting direction" or "cartridge inserting direction". A liquid supply portion 56 and a contact 51 are provided on a front face 50*a*. The liquid supply portion 56 is formed of an elastic material such as rubber for sealing an opening formed in the front face 50*a*. When the cartridge 50 has been completely mounted on the tank mount portion 30, a hollow needle 37 which will be described below penetrates or passes through the liquid supply portion 56 (i.e., the elastic member), whereby the cartridge 50 and the corresponding head 10 are connected to each other with a pump, not shown, and a tube, not shown, connected to the hollow needle 37. As a result, the liquid in the cartridge 50 is supplied to the head 10. It is noted that each pump is driven by the controller 1*p* only when the liquid is forced to be transferred to the head 10 (i.e., only upon a purging operation and an initial introduction of the liquid). In the image recording, a negative pressure is generated in a liquid channel in the head 10, and thereby the liquid in the cartridge 50 is automatically supplied to the head 10. The contact 51 of the cartridge 50 in the present embodiment is a contact of an IC chip storing liquid information of the cartridge 50 (e.g., a type and an amount of the liquid), but the contact 51 may be a contact for supplying an electric power to components such as the sensor provided on the cartridge 50, for example.

Each head 10 is a line head elongated in the main scanning direction and has a generally rectangular parallelepiped shape as its outer shape. The two heads 10 are supported by the frame 3 so as to be distant from each other in a sub-scanning direction that is perpendicular to the main scanning direction. Further, each head 10 is supported by the frame 3 so as to face the support portion 60 with a space appropriate for the recording therebetween when the upper casing 1*a* is located at the close position. On an upper face of the head 10 is provided a joint on which the tube connected to the hollow needle 37 is to be fitted. The head 10 has a multiplicity of ejection openings opening in the ejection face 10*a* as a lower face of the head 10. In the head 10 are formed channels through which the liquid supplied from the cartridge 50 flows to the ejection openings.

As shown in FIG. 2, the sheet-supply unit 1*c* includes a sheet-supply tray 20 and the sheet-supply roller 21. The sheet-supply tray 20 can be mounted on and removed from the lower casing 1*b* in the sub-scanning direction. The sheet-supply tray 20 has a box-like shape opening upward and can accommodate various sizes of the sheets P. The sheet-supply roller 21 is rotated by the control of the controller 1*p* to supply an uppermost one of the sheets P in the sheet-supply tray 20. The sheet P supplied by the sheet-supply roller 21 is conveyed to the support portion 60 by the conveyance roller pairs 22, 23 in order while being guided by guides 29.

As shown in FIG. 2, the support portion 60 is disposed so as to face the recording portion 9 in a vertical direction. The support portion 60 includes: two platens 61 respectively facing the heads 10; and a frame 11 for supporting these platens 61. The frame 11 supports a lower roller of the conveyance roller pair 24 rotatably. Each of the platens 61 is one size larger in size than a corresponding one of the ejection faces 10*a* in the main scanning direction and the sub-scanning direction.

A face of each platen 61 is the support face 61*a* for supporting the sheet P while facing the corresponding ejection face 10*a*. A material and a processing for the support face 61*a* are determined so as to reliably hold the sheet P. For example, a silicon layer having a low viscosity is formed on the support face 61*a*, and a multiplicity of ribs are formed on the support face 61*a* in the sub-scanning direction, preventing floating and the like of the sheet P placed on the support face 61*a*. The platen 61 is formed of a resin material.

Figure 3C:
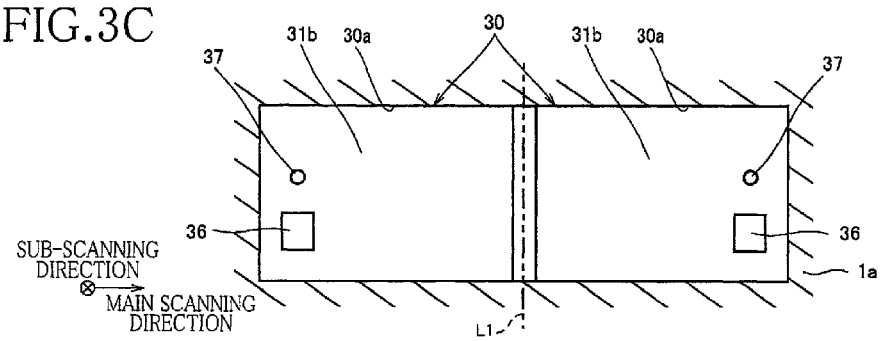

There will be next explained constructions of the tank mount portions 30 with reference to FIGS. 2 and 3A-3C. As shown in FIGS. 2 and 3C, the two tank mount portions 30 are provided in an upper portion of the upper casing 1*a*. These tank mount portions 30 are arranged side by side in the main scanning direction. As shown in FIG. 3C, two openings 31*a* of the respective tank mount portions 30 are symmetrical with respect to a line L1 (indicated by a two-dot chain line) that extends in the vertical direction so as to pass through a center line of the two tank mount portions 30 in the main scanning direction. It is noted that the tank mount portions 30 have the same construction, and the following explanation is made for one of the tank mount portion 30 for the sake of simplicity.

As shown in FIGS. 3A-3C, the tank mount portion 30 includes: a casing 30*a* accommodated in the upper casing 1*a* and having a three-sided rectangular shape in its cross section; and a generally rectangular recessed portion 31 which is defined by the casing 30*a* and on (in) which the cartridge 50 is mountable. This recessed portion 31 has an opening 31*a* through which the cartridge 50 is to be inserted and which is formed in a front face of the upper casing 1*a*. The recessed portion 31 extends from the opening 31*a* toward a downstream side thereof in the cartridge mounting direction. As a result, as shown in FIG. 3A, when the upper casing 1*a* is located at the close position, the cartridge mounting direction coincides with the horizontal direction, and as shown in FIG. 3B, when the upper casing 1*a* is located at the distant position, the cartridge mounting direction coincides with a direction having a vertically downward component.

A tank bottom sensor (as one example of a first sensor) 36 and the hollow needle 37 are provided on a bottom portion 31*b* of the casing 30*a* as a downstream face thereof in the cartridge mounting direction. That is, the tank bottom sensor 36 and the hollow needle 37 are arranged on a downstream end of the casing 30*a* in the cartridge mounting direction. When the cartridge 50 is completely or fully mounted in the recessed portion 31, the tank bottom sensor 36 is electrically connected to the contact 51 (see FIG. 3C). Only when the tank bottom sensor 36 is detecting its connection to the contact 51, the tank bottom sensor 36 outputs a detection signal to the controller 1*p*. The controller 1*p* judges whether the cartridge 50 is completely mounted on the tank mount portion 30 or not on the basis of the presence or absence of the detection signal outputted from the tank bottom sensor 36. Here, a state in which the cartridge 50 is completely mounted on the tank mount portion 30 is a state in which the liquid supply portion 56 is located at a set place for the cartridge 50 (a mount position of the cartridge 50) when the liquid supply portion 56 is penetrated by the hollow needle 37. When the cartridge 50 is located at the set place, the liquid stored in the cartridge 50 is supplied to the head 10, making it possible to record the image on the sheet P. It is noted that the tank bottom sensor 36 is provided by an IC board in the present embodiment. As a modification, the tank bottom sensor 36 may be provided by a contact electrically connectable to the contact for supplying the electric power to the components such as the sensor provided on the cartridge 50, for example.

The hollow needle 37 is connected to the tube, not shown, connected to the head 10. The hollow needle 37 extends from the bottom portion 31*b* of the casing 30*a* toward an upstream side thereof in the cartridge mounting direction. As a result, as shown in FIG. 3B, when the cartridge 50 has been completely mounted on the tank mount portion 30, the hollow needle 37 penetrates through the liquid supply portion 56, whereby the cartridge 50 and the head 10 are connected to and communicate with each other.

On an inner face of the casing 30*a* and near the opening 31*a*, there is provided a cover sensor (as one example of a second sensor) 35 for detecting that the tank cover 5 is closed and outputting a detection signal to the controller 1*p* only when the cover sensor 35 is detecting that the tank cover 5 is closed. The controller 1*p* judges whether the tank cover 5 is closed or not on the basis of the presence or absence of the detection signal outputted from the cover sensor 35.

Figure 4A:
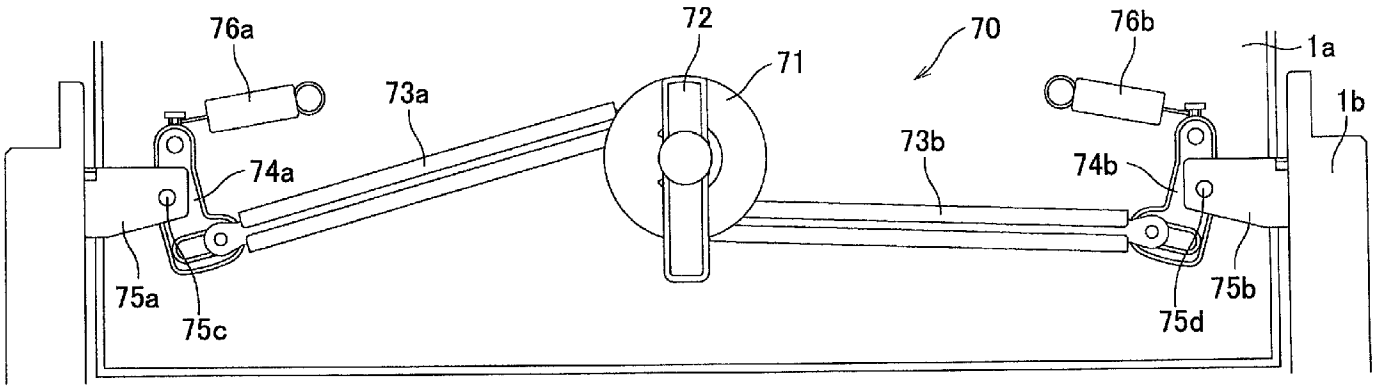
FIG. 4 is a front elevational view of a lock mechanism.
Figure 4B:
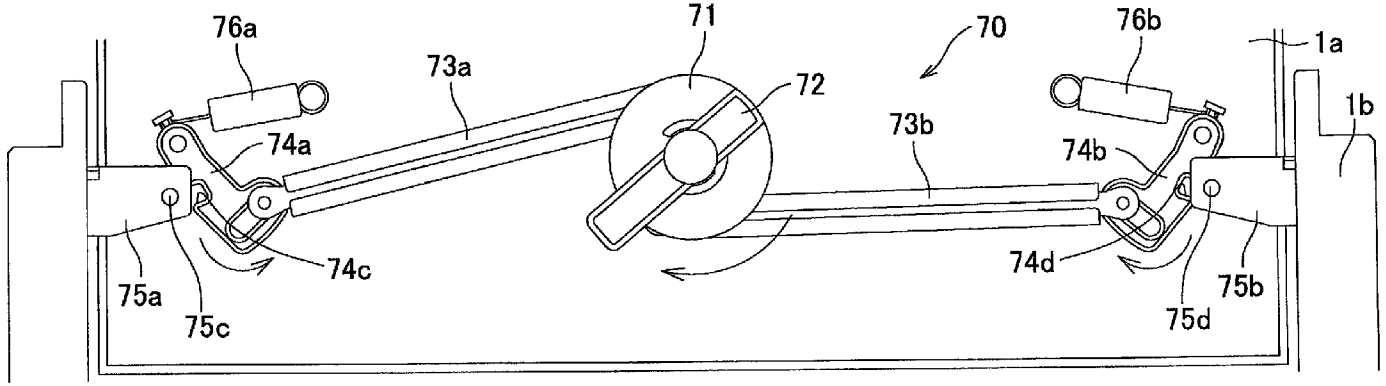

There will be next explained a construction of the lock mechanism 70 with reference to FIGS. 4A and 4B.

The lock mechanism 70 includes: a rotational member 71 having a circular cylindrical shape; interlocked members 73*a*, 73*b*; pivot members 74*a*, 74*b*; springs 76*a*, 76*b*; fixed members 75; 75*b*; and shaft members 75*c*, 75*d*. The rotational member 71, the interlocked members 73*a*, 73*b*, the pivot members 74; 74*b*, and the springs 76; 76*b* are accommodated and held in the upper casing 1*a*. The fixed members 75*a*, 75*b* and the shaft members 75*c*, 75*d* are accommodated and held in the lower casing 1*b*. One end of each of the interlocked members 73; 73*b* in its longitudinal direction is connected to an outer circumferential face of the rotational member 71. Each of the pivot members 74; 74*b* is connected to the other end of a corresponding one of the interlocked members 73; 73*b* in its longitudinal direction. The pivot members 74; 74*b* respectively have recessed portions 74*c*, 74*d* engageable with the respective shaft members 75*c*, 75*d*. Each of the springs 76*a*, 76*b* is connected to an upper end of a corresponding one of the pivot members 74*a*, 74*b*. Each of the fixed members 75*a*, 75*b* projects from the lower casing 1*b* toward the rotational member 71. Each of the shaft members 75*c*, 75*d* extends in the sub-scanning direction and fixed to a corresponding one of the fixed members 75*a*, 75*b* so as to be engageable with the corresponding one of the recessed portions 74*c*, 74*d*.

A handle or lever 72 having a rod-like shape is fixed to a front face of the rotational member 71. The handle 72 can be manually rotated by the user and is rotated together with the rotational member 71. The handle 72 can be positioned at a first position shown in FIG. 4A and a second position shown in FIG. 4B.

As shown in FIG. 4A, the handle 72 at the first position extends in the vertical direction. When the handle 72 is located at the first position, the recessed portions 74*c*, 74*d* of the respective pivot members 74*a*, 74*b* are engaged with the respective shaft members 75*c*, 75*d*. This engagement limits the movement of the upper casing 1*a* for inhibiting the upper casing 1*a* located at the close position from pivoting toward the distant position. That is, when the handle 72 is located at the first position and when the upper casing 1*a* is located at the close position, the movement of the upper casing 1*a* is limited.

On the other hand, as shown in FIG. 4B, the handle 72 at the second position inclines with respect to the vertical direction. When the handle 72 is located at the second position, the engagement of the recessed portions 74*c*, 74*d* of the respective pivot members 74*a*, 74*b* with the respective shaft members 75*c*, 75*d* is released (in other words, the recessed portions 74*c*, 74*d* and the respective shaft members 75*c*, 75*d* are disengaged from each other). Thus, the movement of the upper casing 1*a* is allowed. That is, when the handle 72 is located at the second position, the movement of the upper casing 1*a* is allowed.

The springs 76*a*, 76*b* respectively urge the upper ends of the respective pivot members 74*a*, 74*b* in the direction directed from the upper ends toward the rotational member 71. As a result, as shown in FIG. 4A, in a situation in which an external force is not applied, the portions of the lock mechanism 70 are at rest in the state in which the handle 72 is located at the first position. As shown in FIG. 4B, when the handle 72 has been rotated in a clockwise direction against the urging forces of the springs 76*a*, 76*b* and thereby positioned at the second position, the movement of the upper casing 1*a* is allowed. Thus, the urging forces of the springs provided on the shaft 1*h* move the upper casing 1*a* from the close position to the distant position.

The lock mechanism 70 is provided with a solenoid 77 (see FIG. 6) for inhibiting the rotation of the handle 72. The solenoid 77 can inhibit the rotation of the handle 72 in the state in which the handle 72 is located at the first position, that is, in the state in which the pivotal movement of the upper casing 1*a* is limited.

The lock mechanism 70 can establish (i) a limitation state in which the rotation of the handle 72 located at the first position is inhibited by the solenoid 77, and thereby the pivotal movement of the upper casing 1*a* is limited and (ii) a release state in which the rotation of the handle 72 located at the first position is allowed, and thereby the pivotal movement of the upper casing 1*a* is allowed. That is, in the present embodiment, the limitation state of the lock mechanism 70 is a state in which the limitation of the lock mechanism 70 cannot be released (i.e., the state in which the rotation of the handle 72 is inhibited) in the state in which the pivotal movement of the upper casing 1*a* is limited by the lock mechanism 70 (i.e., the state in which the handle 72 is located at the first position). The release state of the lock mechanism 70 is a state in which the release of the limitation of the lock mechanism 70 is allowed (i.e., the state in which the rotation of the handle 72 is allowed) although the pivotal movement of the upper casing 1*a* is limited by the lock mechanism 70 (that is, the handle 72 is located at the first position).

When the lock mechanism 70 is in the limitation state, the solenoid 77 inhibits the rotation of the handle 72 located at the first position. Thus, the user cannot rotate the handle 72 located at the first position. That is, when the lock mechanism 70 is in the limitation state, the pivotal movement of the upper casing 1*a* located at the close position is limited.

When the lock mechanism 70 is in the release state, the user can rotate the handle 72 located at the first position in the clockwise direction against the urging forces of the springs 76*a*, 76*b*. When the user has rotated the handle 72 located at the first position, the upper casing 1*a* is pivoted from the close position to the distant position. That is, when the lock mechanism 70 is in the release state, the pivotal movement of the upper casing 1*a* located at the close position can be allowed. It is noted that, after the pivotal movement, the detection signal is not outputted from the upper casing sensor 84 to the controller 1*p*, and thus the controller 1*p* judges that the upper casing 1*a* is located at the distant position.

On the other hand, when the user has manually moved or returned the upper casing 1*a* from the distant position to the close position against the urging forces of the springs provided on the shaft 1*h*, the handle 72 and the lower casing 1*b* are automatically reengaged with each other by the urging forces of the springs 76*a*, 76*b*. In this operation, the detection signal is outputted from the upper casing sensor 84 to the controller 1*p*. As a result, the controller 1*p* judges that the upper casing 1*a* has returned from the distant position to the close position (noted that the handle 72 and the lower casing 1*b* have been reengaged with each other at this time).

The switch between the limitation state and the release state of the lock mechanism 70 is performed by the control of the solenoid 77 by the controller 1*p*. Specifically, the controller 1*p* controls the solenoid 77 on the basis of a mount state of the cartridge 50 on the tank mount portion 30 (hereinafter may be referred to as "tank mount state" or "cartridge mount state").

Figure 5A:
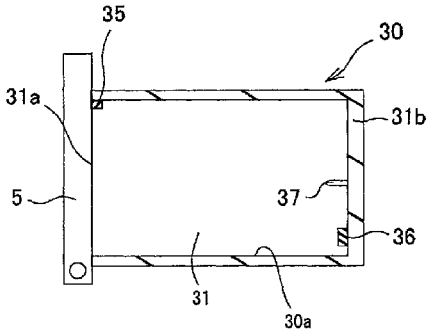
Figure 5B:
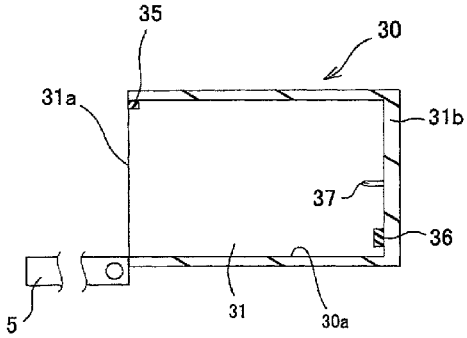
Figure 5C:
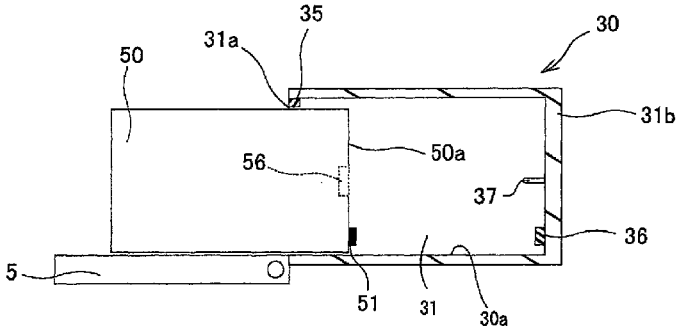
Figure 5D:
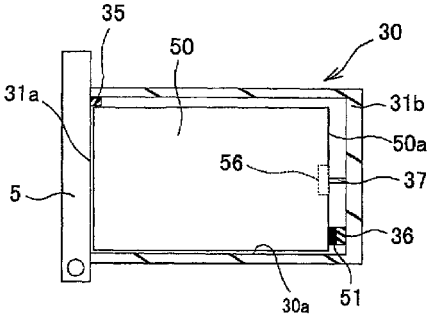
Figure 5E:
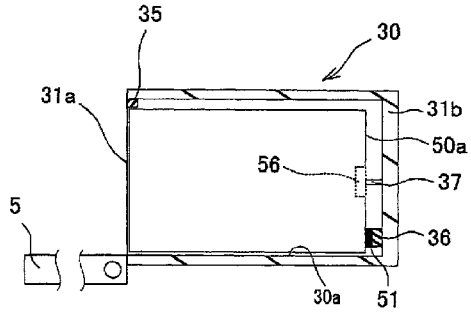

There will be next explained the tank mount state with reference to FIGS. 5A-5E. The tank mount state includes an empty state (see FIGS. 5A and 5B) and a partially mounted state (see FIG. 5C), and a completely mounted state (see FIGS. 5D and 5E). The empty state is a state in which any part of the cartridge 50 does not exist in the tank mount portion 30. The partially mounted state is a state in which a part of the cartridge 50 exists in the tank mount portion 30, but the cartridge 50 is not completely mounted on the tank mount portion 30 (that is, the contact 51 and the tank bottom sensor 36 are not electrically connected to each other). The completely mounted state is a state in which the entire cartridge 50 is completely mounted in the tank mount portion 30 (that is, the contact 51 and the tank bottom sensor 36 are electrically connected to each other). It is noted that the empty state includes a state in which the tank cover 5 is closed as shown in FIG. 5A (hereinafter may be called "empty state A") and a state in which the tank cover 5 is not closed as shown in FIG. 5B (hereinafter may be called "empty state B"). That is, the empty state A and the empty state B are different in an open or closed state of the tank cover 5 but each is the state in which the cartridge 50 does not exist in the tank mount portion 30. Likewise, the completely mounted state includes the state in which the tank cover 5 is closed as shown in FIG. 5D (hereinafter may be called "completely mounted state A") and the state in which the tank cover 5 is not closed as shown in FIG. 5E (hereinafter may be called "completely mounted state B"). That is, the completely mounted state A and the completely mounted state B are different in the open or closed state of the tank cover 5 but the same as each other in the position of the cartridge 50 relative to the tank mount portion 30.

There will be next explained the controller 1*p* with reference to FIG. 6. The controller 1*p* includes: a central processing unit (CPU); a nonvolatile memory for rewritably storing programs executed by the CPU and data used for these programs; and a random access memory (RAM) for temporarily storing the date upon the execution of the program. The controller 1*p* includes various functional sections which are constituted by cooperation of these hardware and software in the nonvolatile memory with each other. The controller 1*p* is for controlling an entire operation of the printer 1 and includes a recording data storage section 130, a conveyance control section 131, a head control section 132, a judging section 133, a limitation control section 134, and a display control section 135.

The recording data storage section 130 stores recording data transmitted from an external device such as a PC. The recording data includes conveyance data and image data representative of an image to be recorded on the sheet P (i.e., ejection data of the ink and the treatment liquid for the heads 10).

The conveyance control section 131 is configured to control the sheet-supply roller 21 and the conveyance roller pairs 23-28 to convey the sheet P through the sheet conveyance path on the basis of the conveyance data of the recording data stored in the recording data storage section 130. The head control section 132 is configured to control each head 10 to eject the treatment liquid or the ink of a desired volume onto the sheet P on the basis of the image data of the recording data stored in the recording data storage section 130.

In the state in which the detection signal outputted from the upper casing sensor 84 has been received by the controller 1*p* (in other words, in the state in which the controller 1*p* is receiving the detection signal outputted from the upper casing sensor 84), the judging section 133 is configured to judge whether or not the tank mount state is a middle-of-mounting state in which the cartridge 50 is being mounted, on the basis of the presence or absence of the detection signals outputted from the cover sensor 35 and the tank bottom sensor 36. Specifically, in a case where the controller 1*p* is not receiving the detection signals from the cover sensor 35 and the tank bottom sensor 36, the judging section 133 judges that the tank mount state is the middle-of-mounting state. The case where the controller 1*p* is not receiving the detection signals from the cover sensor 35 and the tank bottom sensor 36 includes the empty state B (see FIG. 5B) and the partially mounted state (see FIG. 5C). That is, where the controller 1*p* is not receiving the detection signals from the cover sensor 35 and the tank bottom sensor 36, the judging section 133 cannot judge whether the tank mount state is the empty state B or the partially mounted state, but in this case, the judging section 133 judges that the tank mount state is the middle-of-mounting state in the present embodiment. In a case where the controller 1*p* is receiving the detection signal(s) outputted from at least one of the cover sensor 35 and the tank bottom sensor 36, the judging section 133 judges that the tank mount state is not the middle-of-mounting state. The case where the controller 1*p* is receiving the detection signal(s) outputted from at least one of the cover sensor 35 and the tank bottom sensor 36 includes the empty state A (see FIG. 5A), the completely mounted state A (see FIG. 5D), and the completely mounted state B (see FIG. 5E).

Further, when a state of receiving the detection signals outputted from the cover sensor 35, the tank bottom sensor 36, and the upper casing sensor 84 has been changed, the judging section 133 judges that a state of the printer 1 has been changed (that is, a transition of the state of the printer 1 has been caused).

The limitation control section 134 is configured to control the solenoid 77 such that the lock mechanism 70 takes or establishes the limitation state, when the judging section 133 has judged that the tank mount state is the middle-of-mounting state where the upper casing 1*a* is located at the close position. When the judging section 133 has judged that the tank mount state is not the middle-of-mounting state where the upper casing 1*a* is located at the close position, the limitation control section 134 controls the solenoid 77 such that the lock mechanism 70 takes or establishes the release state. Further, when the recording operation for recording the image on the sheet P is being performed by the controls of the head control section 132 and the conveyance control section 131, the limitation control section 134 controls the solenoid 77 such that the lock mechanism 70 takes the limitation state.

The display control section 135 is configured to display a message for prompting the user to close the tank cover 5 on the display 90 when the judging section 133 has judged that the tank mount state is the middle-of-mounting state.

Figure 7:
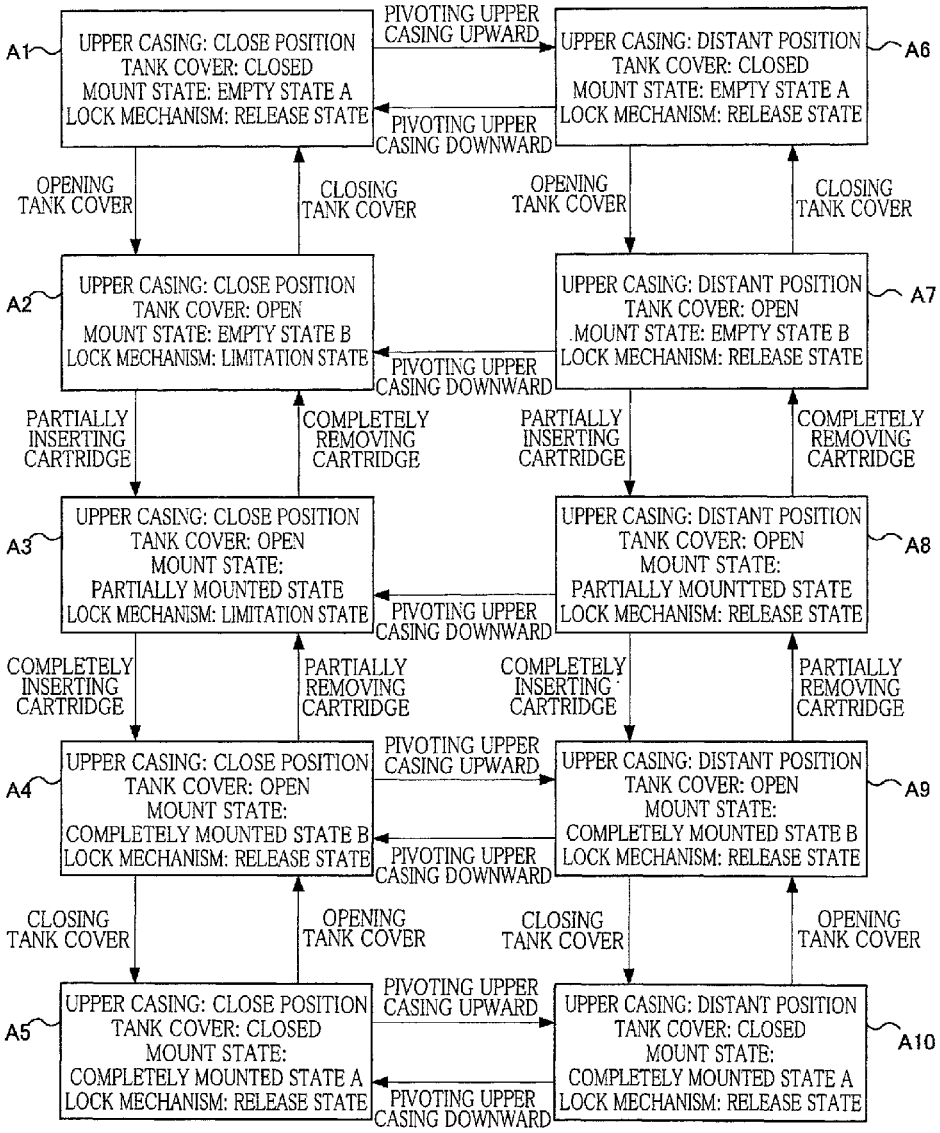
FIG. 7 is a state transition diagram of the printer.

There will be next explained, with reference to FIGS. 7 and 8, the transition of the state of the printer 1 (noted that the state includes the tank mount state and the position of the upper casing 1*a*). Each of states A1-A10 shown in FIG. 7 is changed by an operation of the user such as the insertion and removal of the cartridge 50 into or from the tank mount portion 30 and the pivotal movement of the upper casing 1*a*. Each of the states A1-A5 is the state in which the upper casing 1*a* is located at the close position, and each of the states A6-A10 is the state in which the upper casing 1*a* is located at the distant position. Thus, as shown in FIG. 8, in the states A1-A5, the controller 1*p* is receiving the detection signal from the upper casing sensor 84, and in the states A6-A10, the controller 1*p* is not receiving the detection signal from the upper casing sensor 84.

The state A1 is a state in which the upper casing 1*a* is located at the close position, and the tank mount state is the empty state A. As shown in FIG. 8, in this state A1, the controller 1*p* is receiving the detection signal from the cover sensor 35 and is not receiving the detection signal from the tank bottom sensor 36. Thus, the judging section 133 judges that the tank mount state is not the middle-of-mounting state (that is, the judging section 133 judges that the tank mount state is the empty state). The limitation control section 134 then controls the solenoid 77 such that the lock mechanism 70 takes the release state. As a result, since the pivotal movement of the upper casing 1*a* is allowed, the user can rotate the handle 72 of the lock mechanism 70 to pivot the upper casing 1*a* upward to the distant position. As a result, the user can perform the maintenance operation in the printer 1 such as the jamming resolving operation.

In the state A1, when the user has opened the tank cover 5, the tank mount state is changed to the empty state B, and the state of the printer 1 is changed to the state A2. As shown in FIG. 8, in this state A2, since the controller 1*p* is not receiving the detection signals from the cover sensor 35 and the tank bottom sensor 36, the judging section 133 judges that the tank mount state is the middle-of-mounting state. The limitation control section 134 then controls the solenoid 77 such that the lock mechanism 70 takes the limitation state. As a result, the pivotal movement of the upper casing 1*a* is limited.

It is noted that, in this state A2, since the pivotal movement of the upper casing 1*a* is limited, the user cannot pivot the upper casing 1*a* for the maintenance operation for the inside of the printer 1. To allow the pivotal movement of the upper casing 1*a*, the user needs to close the tank cover 5 or change the tank mount state to the completely mounted state A or the completely mounted state B. However, since the user intends to pivot the upper casing 1*a* for the maintenance operation for the inside of the printer 1, the user may not recognize the need to close the tank cover 5 or change the tank mount state to the completely mounted state. In order to solve this problem, the message for prompting the user to close the tank cover 5 is displayed on the display 90 in this state A2. When the user having viewed this message has closed the tank cover 5, the state of the printer 1 is changed from the state A2 to the state A1. In the state A1, the pivotal movement of the upper casing 1*a* is allowed as described above. Thus, the user can pivot the upper casing 1*a* upward to the distant position to perform the maintenance operation. Accordingly, displaying the message for prompting the user to close the tank cover 5 on the display 90 in the state A2 can improve an operability of the user.

When the cartridge 50 has been partially inserted into the tank mount portion 30 in the state A2, the tank mount state is changed to the partially mounted state (see FIG. 5C), and the state of the printer 1 is changed to the state A3. As shown in FIG. 8, in this state A3, since the controller 1*p* is not receiving the detection signals from the cover sensor 35 and the tank bottom sensor 36 as in the state A2, the judging section 133 judges that the tank mount state is the middle-of-mounting state. The limitation control section 134 then controls the solenoid 77 such that the lock mechanism 70 takes the limitation state. As a result, the pivotal movement of the upper casing 1*a* is limited. As thus described, when the cartridge 50 is being inserted, since the pivotal movement of the upper casing 1*a* is limited, the cartridge 50 never moves in the tank mount portion 30 with the pivotal movement of the upper casing 1*a*, making it possible to prevent or suppress damages to the cartridge 50 and the tank mount portion 30. It is noted that, if the pivotal movement of the upper casing 1*a* is not limited when the cartridge 50 is being inserted (or the cartridge 50 is partially mounted), the following problems 3 arise. That is, the user has rotated the handle 72 to release the engagement of the recessed portions 74*c*, 74*d* of the respective pivot members 74*a*, 74*b* with the respective shaft members 75*c*, 75*d*, the upper casing 1*a* pivots upward with a relatively great force by the urging forces of the springs provided on the shaft 1*h*. In this pivotal movement, the cartridge 50 moves in the tank mount portion 30 with the pivotal movement of the upper casing 1*a*. Thus, the cartridge 50 may drop off the tank mount portion 30 or collide with the tank mount portion 30, resulting in the damages to the cartridge 50 and the tank mount portion 30.

When the cartridge 50 has been further inserted into the tank mount portion 30 in the state A3, the tank mount state is changed to the completely mounted state B, and the state of the printer 1 is changed to the state A4. As shown in FIG. 8, in this state A4, the controller 1*p* is not receiving the detection signal from the cover sensor 35 and is receiving the detection signal from the tank bottom sensor 36. Thus, the judging section 133 judges that the tank mount state is not the middle-of-mounting state (that is, the judging section 133 judges that the tank mount state is the completely mounted state). The limitation control section 134 then controls the solenoid 77 such that the lock mechanism 70 takes the release state. As a result, the pivotal movement of the upper casing 1*a* is allowed.

When the user has closed the tank cover 5 in the state A4, the tank mount state is changed to the completely mounted state A, and the state of the printer 1 is changed to the state A5. As shown in FIG. 8, in this state A5, the controller 1*p* is receiving the detection signals from the cover sensor 35 and the tank bottom sensor 36. Thus, the judging section 133 judges that the tank mount state is not the middle-of-mounting state (that is, the judging section 133 judges that the tank mount state is the completely mounted state). As a result, as in the state A4, the pivotal movement of the upper casing 1*a* is allowed.

The states A6-A10 shown in FIG. 7 respectively correspond to states in which the upper casing 1*a* is located at the distant position in the respective states A1-A5. The states A1, A4, A5 can be respectively changed to the states A6, A9, A10 by pivoting the upper casing 1*a* upward from the close position to the distant position. However, the states A2, A3 cannot be directly changed to the respective states A7, A8 because the pivotal movement of the upper casing 1*a* is limited. On the other hand, the states A6-A10 can be respectively changed to the states A1-A5 by pivoting the upper casing 1*a* downward from the distant position to the close position because the upper casing 1*a* is located at the distant position.

It is noted that, in the state A8, since the pivotal movement of the upper casing 1*a* is not limited, when the upper casing 1*a* has been pivoted downward from the distant position to the close position, the cartridge 50 partially inserted may move in the tank mount portion 30 with the pivotal movement of the upper casing 1*a*. However, since the cartridge mounting direction coincides with the horizontal direction when the upper casing 1*a* is located at the close position and coincides with the direction having the vertically downward component when the upper casing 1*a* is located at the distant position, even when the cartridge 50 has moved in the tank mount portion 30 with the downward pivotal movement of the upper casing 1*a*, a direction in which the cartridge 50 moves is a direction directed mainly from the bottom portion 31*b* toward the opening 31*a*. Thus, there is a low possibility that the cartridge 50 and the tank mount portion 30 are damaged due to the collision therebetween. Further, since the downward pivotal movement of the upper casing 1*a* is performed by the user relatively slowly against the urging forces of the springs provided on the shaft 1*h*, there is an extremely low possibility that the cartridge 50 drops off the tank mount portion 30, or the cartridge 50 and the tank mount portion 30 collide with each other.

There will be next explained the recording operation of the printer 1.

The recording operation is started when the controller 1*p* has received the recording data (i.e., a recording command) outputted from the external device. Specifically, the controller 1*p* drives the components such as the sheet-supply roller 21 and the conveyance roller pairs 22-28 on the basis of the recording data transmitted from the external device. The sheet P supplied from the sheet-supply tray 20 is conveyed to the support portion 60 while being guided by the guides 29. The sheet P conveyed to the support portion 60 is nipped and conveyed by the conveyance roller pairs 23, 24, 25 while being supported by the support faces 61*a*. When the sheet P passes through positions just under the respective two heads 10 in order, the controller 1*p* controls the heads 10 to eject the liquid from the ejection openings of the ejection faces 10*a* onto a face of the sheet P to form the image on the sheet P. The liquid ejecting operation from the ejection openings is performed under the control of the controller 1*p* on the basis of a detection signal outputted from the sheet sensor 42. The sheet P is then conveyed upward by the conveyance roller pairs 26, 27, 28 while being guided by the guides 29 and discharged onto the sheet-discharge portion 41 through an opening 40 formed in the upper portion of the upper casing 1*a*.

During the recording operation, the controller 1*p* can detect an occurrence of the jamming (i.e., the jamming of the sheet P in the sheet conveyance path). Specifically, the controller 1*p* senses the occurrence of the jamming on the basis of signals outputted from the sheet sensor 42 and/or the conveyance roller pairs 22-28. When the jamming has occurred in the recording operation, the controller 1*p* controls the heads 10 and the conveyance roller pairs 22-28 to suspend the recording operation. The user then pivots the upper casing 1*a* upward to the distant position to perform the jamming resolving operation (that is an operation for resolving the jamming of the sheet P in the sheet conveyance path). The user removes the jammed sheet P at the work space formed between the upper and lower casings 1*a*, 1*b* and then returns the upper casing 1*a* to the close position. As a result, the jamming resolving operation is completed. Then, when the controller 1*p* has received another recording command from the external device, the recording operation is started.

Figure 9:
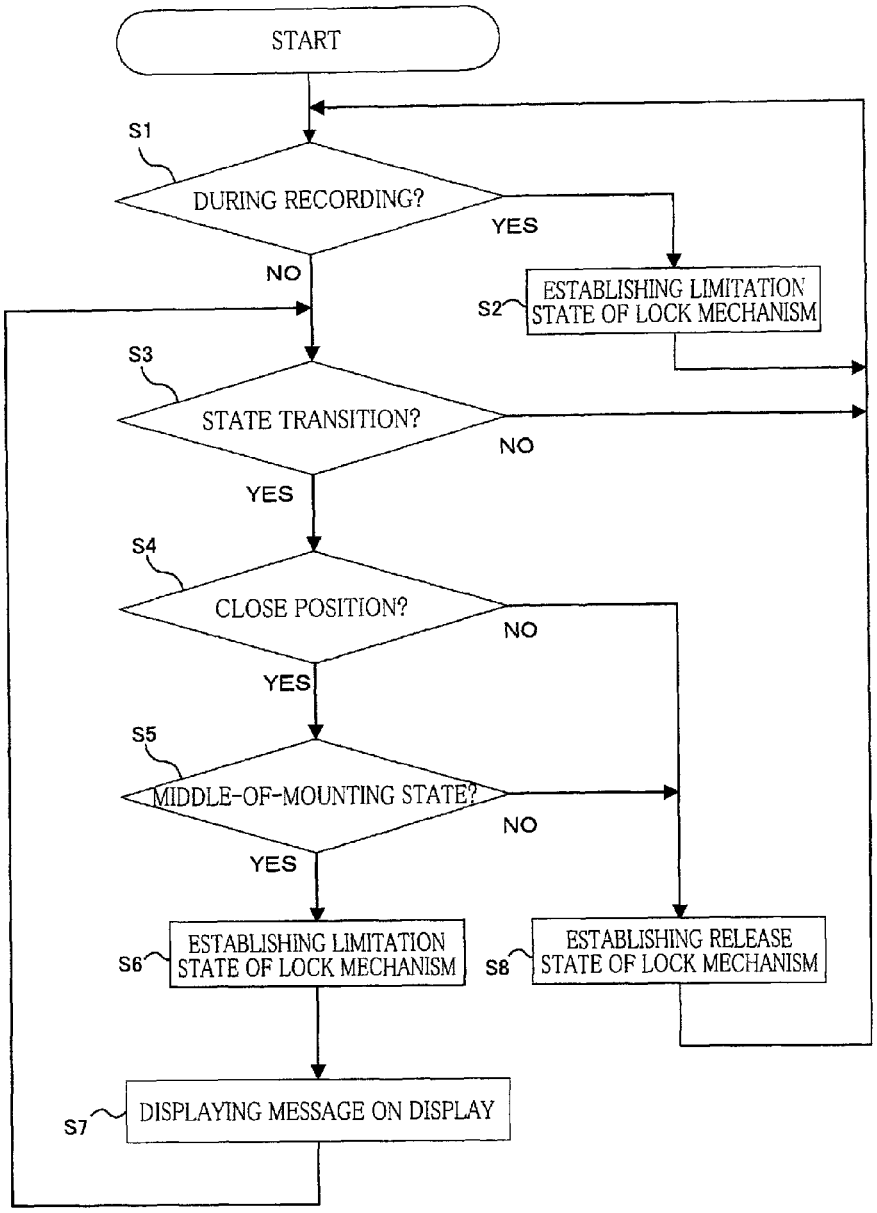
FIG. 9 is a flow-chart showing an operation of the printer.

There will be next explained the switching operation for switching the limitation state and the release state of the lock mechanism 70 with reference to FIG. 9.

In S1, the controller 1*p* judges whether the recording operation is being performed by the conveyance control section 131 and the head control section 132 or not. Where the controller 1*p* has judged that the recording operation is being performed (S1: YES), the limitation control section 134 in S2 controls the solenoid 77 such that the lock mechanism 70 takes the limitation state. As a result, the pivotal movement of the upper casing 1*a* is limited, making it possible to prevent a malfunction of the printer 1 caused by the pivotal movement of the upper casing 1*a* in the recording operation through carelessness of the user, for example. When the processing in S2 is finished, the controller 1*p* returns to S1. Here, the malfunction of the printer 1 includes the jamming of the sheet P, the attachment of the ink to the support faces 61*a*, and damage to the ejection faces 10*a* due to contact between the sheet P and the ejection faces 10*a*.

On the other hand, where the controller 1*p* has judged that the recording operation is not being performed (S1: NO), the judging section 133 in S3 judges whether the state of the printer 1 has been changed or not. Where the controller 1*p* has judged that the state of the printer 1 has not been changed (S3: NO), the controller 1*p* returns to S1. On the other hand, where the controller 1*p* has judged that the state of the printer 1 has been changed (S3: YES), the controller 1*p* in S4 judges whether the upper casing 1*a* is located at the close position or not on the basis of the presence or absence of the detection signal from the upper casing sensor 84. Where the controller 1*p* has judged that the upper casing 1*a* is not located at the close position (that is, where the controller 1*p* has judged that the upper casing 1*a* is located at the distant position) (S4: NO), the controller 1*p* goes to S8.

On the other hand, where the controller 1*p* has judged that the upper casing 1*a* is located at the close position (S4: YES), the judging section 133 in S5 judges whether the tank mount state is the middle-of-mounting state or not on the basis of the presence or absence of the detection signals from the cover sensor 35 and the tank bottom sensor 36. Where the controller 1*p* has judged that the tank mount state is not the middle-of-mounting state (that is, where the judging section 133 has judged that the tank mount state is the empty state A or the completely mounted state A or B) (S5: NO), the controller 1*p* goes to S8.

In S8, the limitation control section 134 controls the solenoid 77 such that the lock mechanism 70 takes the release state. As a result, the pivotal movement of the upper casing 1*a* is allowed. Thus, when the upper casing 1*a* is located at the close position, the user can pivot the upper casing 1*a* upward from the close position to the distant position to perform the maintenance operation for the inside of the printer 1. It is noted that, also before the state of the printer 1 has been changed, when the state of the lock mechanism 70 is the release state, the limitation control section 134 controls the solenoid 77 such that the release state is maintained. When the processing in S8 is finished, the controller 1*p* goes to S1.

On the other hand, where the controller 1*p* has judged in S5 that the tank mount state is the middle-of-mounting state (that is, where the controller 1*p* has judged that the tank mount state is the empty state B or the partially mounted state) (S5: YES), the limitation control section 134 in S6 controls the solenoid 77 such that the lock mechanism 70 takes the limitation state. As a result, the pivotal movement of the upper casing 1*a* is limited. Thus, the cartridge 50 partially mounted never moves in the tank mount portion 30 with the pivotal movement of the upper casing 1*a*, making it possible to prevent the damages to the cartridge 50 and the tank mount portion 30. It is noted that, also before the state of the printer 1 has been changed, when the lock mechanism 70 is in the limitation state, the limitation control section 134 controls the solenoid 77 such that the limitation state is maintained.

When the processing in S6 is finished, the display control section 135 in S7 displays on the display 90 the message for prompting the user to close the tank cover 5. As a result, the user closes the tank cover 5 or changes the tank mount state to the completely mounted state A, whereby the pivotal movement of the upper casing 1*a* is allowed. That is, the display of the message can make the user recognize an operation to be performed by the user in order to allow the pivotal movement of the upper casing 1*a*. When the processing in S7 is finished, the controller 1*p* returns to S3.

In the printer 1 as the present embodiment, when the upper casing 1*a* is located at the close position and when the cartridge 50 is being inserted or mounted (that is, when the cartridge 50 is partially inserted or mounted), the pivotal movement of the upper casing 1*a* is limited or inhibited. Thus, the cartridge 50 never moves in the tank mount portion 30 with the pivotal movement of the upper casing 1*a*, making it possible to prevent the damages to the cartridge 50 and the tank mount portion 30.

Further, when the pivotal movement of the upper casing 1*a* is limited, the message for prompting the user to close the tank cover 5 is displayed on the display 90, making it possible for the user to recognize the operation to be performed by the user in order to allow the pivotal movement of the upper casing 1*a*.

Second Embodiment

There will be next explained a printer as a second embodiment to which the present invention is applied with reference to FIG. 10. The second embodiment is different from the first embodiment in that the printer as this second embodiment includes a tank-insertion-end sensor (as one example of a third sensor) 39 indicated by broken lines in FIG. 6 and provided for detecting an existence of the cartridge 50 in the tank mount portion 30. It is noted that the same reference numerals as used in the first embodiment are used to designate the corresponding elements of this second embodiment, and an explanation of which is dispensed with.

In the present embodiment, as shown in FIG. 10A, the tank-insertion-end sensor 39 is provided on the inner face of the casing 30*a* and near the opening 31*a*. The tank-insertion-end sensor 39 outputs a detection signal to the controller 1*p* only when the cartridge 50 has inserted into the tank mount portion 30, and the front face 50*a* of the cartridge 50 has passed through the tank-insertion-end sensor 39 (that is, in a state in which the front face 50*a* is located at a position nearer to the bottom portion 31*b* than the tank-insertion-end sensor 39). The controller 1*p* judges whether the cartridge 50 exists in the tank mount portion 30 or not on the basis of the presence or absence of the detection signal from the tank-insertion-end sensor 39.

Further, in the state in which the detection signal outputted from the upper casing sensor 84 has been received by the controller 1*p*, the judging section 133 judges whether the tank mount state is the middle-of-mounting state or not on the basis of the presence or absence of the detection signals from the cover sensor 35, the tank bottom sensor 36, and the tank-insertion-end sensor 39. Specifically, the judging section 133 judges that the tank mount state is the middle-of-mounting state only in the case where the controller 1*p* is receiving the detection signal from the tank-insertion-end sensor 39 and is not receiving the detection signals from the cover sensor 35 and the tank bottom sensor 3 (i.e., the state in FIG. 5C). As a result, as shown in FIG. 10B, the lock mechanism 70 is in the limitation state only when the printer 1 is in the state A3 (see FIG. 7). That is, when the state of the printer 1 is in the state A2 (see FIG. 7), the judging section 133 judges that the tank mount state is the middle-of-mounting state in the above-described first embodiment, but in the present embodiment, the judging section 133 can accurately judge that the tank mount state is not the middle-of-mounting state or the partially mounted state (that is, the judging section 133 can accurately judge the tank mount state is the empty state). Thus, in the present embodiment, since the pivotal movement of the upper casing 1*a* is not limited also in the state A2, the user can pivot the upper casing 1*a* without closing the tank cover 5, thereby improving the operability.

As a modification of the second embodiment, the judging section 133 may judge whether the tank mount state is the middle-of-mounting state or not on the basis of the presence or absence of the detection signals from the tank bottom sensor 36 and the tank-insertion-end sensor 39, in the state in which the controller 1*p* is receiving the detection signal outputted from the upper casing sensor 84. Specifically, as shown in FIG. 10C, only when the controller 1*p* is receiving the detection signal from the tank-insertion-end sensor 39 and is not receiving the detection signal from the tank bottom sensor 36, the judging section 133 may judge that the tank mount state is the middle-of-mounting state, and the lock mechanism 70 takes the limitation state. Also in this modification, when the state of the printer 1 is the state A2 (see FIG. 7), the judging section 133 can accurately judge that the tank mount state is not the middle-of-mounting state or the partially mounted state (that is, the judging section 133 judges that the tank mount state is the empty state).

While the embodiments of the present invention have been described above, it is to be understood that the invention is not limited to the details of the illustrated embodiments, but may be embodied with various changes and modifications, which may occur to those skilled in the art, without departing from the spirit and scope of the invention. For example, the printer 1 as the above-described embodiments includes the cartridge 50 but, as the recording apparatus, does not need to include the cartridge 50. That is, the printer 1 does not need to have the cartridge 50 as long as the printer 1 includes the tank mount portion 30 on which the cartridge 50 is mountable. Three or more tank mount portions 30 may be provided so as to be arranged in the main scanning direction, and the tank mount portions 30 may be arranged so as to be superposed on each other in the vertical direction. Further, the cartridge 50 has a storage portion for storing the treatment liquid or the ink as the recording agent to be supplied to the head 10 for the image recording, but may have not only the storage portion but also a waste-liquid storage portion for storing waste liquid discharged from the head 10.

Figure 11:
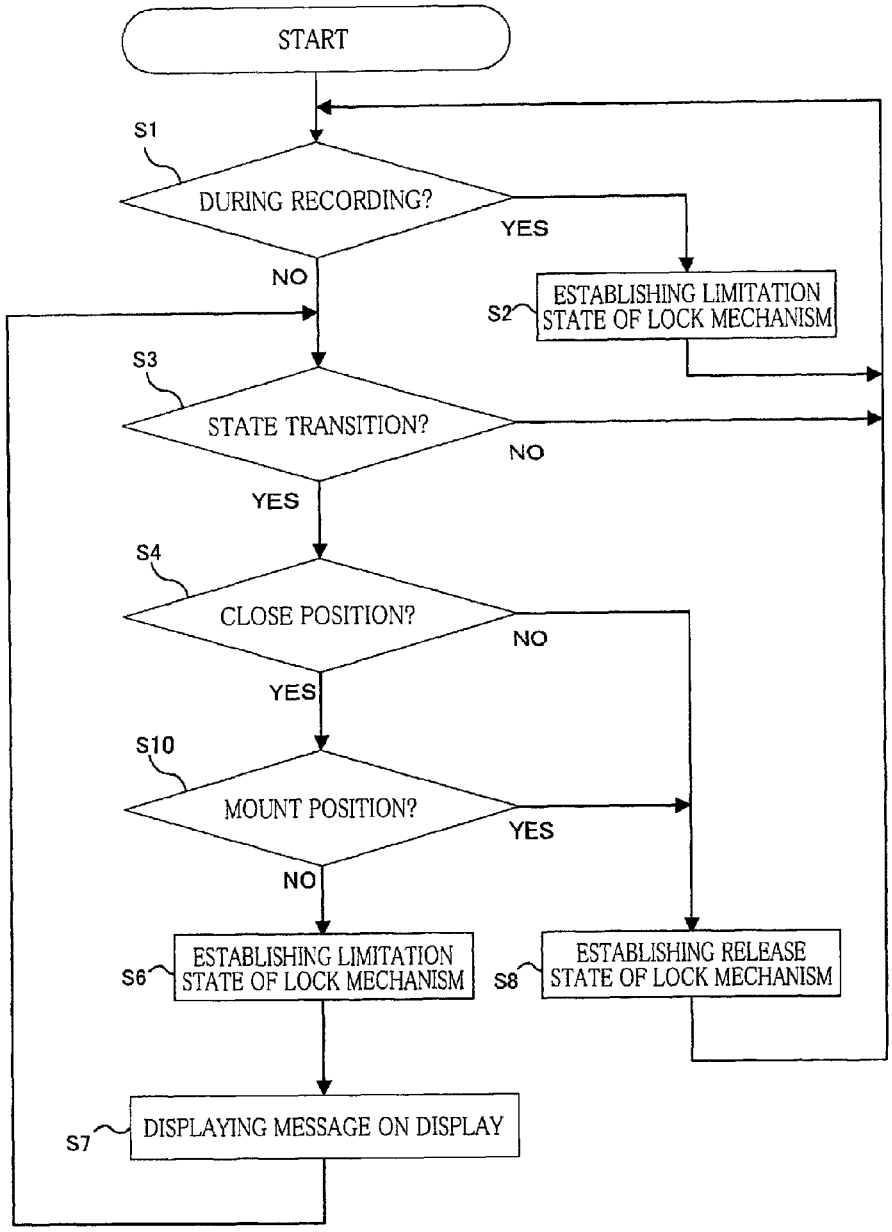
FIG. 11 is a flow-chart showing an operation of a printer as a modification of the first embodiment.

Further, as a modification of the above-described first embodiment, the operation of the printer 1 may be performed as shown in FIG. 11. Specifically, instead of S5 in the flowchart in FIG. 9, the controller 1*p* in S10 judges whether or not the cartridge 50 is disposed at the set place (the mount position) that is the position of the cartridge 50 when the liquid supply portion 56 of the cartridge 50 is penetrated by the hollow needle 37. Where the controller 1*p* has judged that the cartridge 50 is disposed at the set place (S10: YES), the lock mechanism 70 takes the release state. On the other hand, where the controller 1*p* has judged that the cartridge 50 is not disposed at the set place (S10: NO), the lock mechanism 70 takes the limitation state. In this configuration, the controller 1*p* can perform the judgment as to whether the cartridge 50 is disposed at the set place or not, on the basis of only the detection signal of the tank bottom sensor 36. When the tank bottom sensor 36 is detecting its contact with the contact 51 of the cartridge 50, the controller 1*p* judges that the cartridge 50 is disposed at the set place. When the tank bottom sensor 36 is not detecting its contact with the contact 51, the controller 1*p* judges that the cartridge 50 is not disposed at the set place. In this modification, it is possible to prevent the damages to the cartridge 50 and the tank mount portion 30 as in the first embodiment.

Further, the judgment of the controller 1*p* as to whether the cartridge 50 is disposed at the set place or not is not limited to the judgment based on only the detection signal of the tank bottom sensor 36 as in the above-mentioned modification. For example, the controller 1*p* may judge whether the cartridge 50 is disposed at the set place or not on the basis of only the detection signal of the cover sensor 35, only the detection signal of the tank-insertion-end sensor 39, or at least two signals of the tank bottom sensor 36, the cover sensor 35, and the tank-insertion-end sensor 39.

The contact 51 of the cartridge 50 does not need to be the contact electrically connectable to the tank bottom sensor 36. That is, the contact 51 only needs to contact with the tank bottom sensor 36. The tank bottom sensor 36 does not need to be the contact electrically connectable to the contact 51 of the cartridge 50. For example, the tank bottom sensor 36 may be a mechanical switch that is pressed by the contact 51 of the cartridge 50 to output the detection signal.

Further, the judging section 133 may judge whether the tank mount state is the middle-of-mounting state or not on the basis of only the detection signal from the cover sensor 35, only the detection signal from the tank bottom sensor 36, or the detection signals from the cover sensor 35 and the tank-insertion-end sensor 39. Where the judging section 133 makes the judgment on the basis of only the detection signal from the cover sensor 35, the judging section 133 judges that the tank mount state is the middle-of-mounting state when the controller 1*p* is not receiving the detection signal from the cover sensor 35. Where the judging section 133 makes the judgment on the basis of only the detection signal from the tank bottom sensor 36, the judging section 133 judges that the tank mount state is the middle-of-mounting state when the controller 1*p* is not receiving the detection signal from the tank bottom sensor 36. Where the judging section 133 makes the judgment on the basis of the detection signals from the cover sensor 35 and the tank-insertion-end sensor 39, when the controller 1*p* is not receiving the detection signals from the cover sensor 35 and the tank-insertion-end sensor 39 or when the controller 1*p* is receiving the detection signals outputted from the cover sensor 35 and the tank-insertion-end sensor 39, the judging section 133 judges that the tank mount state is not the middle-of-mounting state (that is, the judging section 133 judges that the tank mount state is the empty state or the completely mounted state). On the other hand, when the controller 1*p* is not receiving the detection signal from the cover sensor 35 and is receiving the detection signal outputted from the tank-insertion-end sensor 39, the judging section 133 judges that the tank mount state is the middle-of-mounting state.

The lock mechanism 70 does not need to have the state in which the rotation of the handle 72 is inhibited. In this construction, the limitation state of the lock mechanism 70 is the state in which the handle 72 is located at the first position, i.e., the state in which the pivotal movement of the upper casing 1*a* is limited. Further, the release state of the lock mechanism 70 is the state in which the handle 72 is located at the second position, i.e., the state in which the pivotal movement of the upper casing 1*a* is allowed. In this construction, the limitation control section 134 controls the lock mechanism 70 (the handle 72) such that the lock mechanism 70 is switched between the limitation state and the release state. That is, when the lock mechanism 70 is in the release state, the user can pivot the upper casing 1*a* without any need to operate the handle 72. Further, the lock mechanism 70 does not need to have the handle 72 that is manually rotated by the user. In this construction, the limitation state of the lock mechanism 70 is the state in which the pivotal movement of the upper casing 1*a* is limited, and the release state is the state in which the pivotal movement of the upper casing 1*a* is allowed. Also in this construction, the limitation control section 134 controls the lock mechanism 70 such that the lock mechanism 70 is switched between the limitation state and the release state. Further, the lock mechanism 70 may have any configuration as long as the lock mechanism 70 can limits the pivotal movement of the upper casing 1*a*.

The present invention is also applicable to a line printer and a serial printer. The present invention may be applied not only to the printer but also to devices such as a facsimile machine and a copying machine. Further, the present invention is applicable to a recording apparatus configured to eject liquid other than the ink to perform the recording. The present invention may be applied not only to the ink-jet recording apparatus but also to a laser or a thermal recording apparatus, for example. The recording medium is not limited to the sheet P, and various recordable media may be used.

What is claimed is:

1. A recording apparatus, comprising:

a first casing;

a second casing connected to the first casing with a shaft and pivotable about the shaft with respect to the first casing in a pivotal direction having a vertical component so as to be located at (i) a close position which is close to the first casing and at which an image is recorded on a recording medium and (ii) a distant position farther from the first casing than the close position;

a tank mount portion on which a tank storing a recording agent for recording the image on the recording medium is mountable, the tank mount portion being fixed to the second casing so as to be pivotable together with the second casing;

a force-applying portion configured to be switchable between a first state in which the force-applying portion applies a force to the second casing to limit the pivotal movement of the second casing located at the close position and a second state in which the force-applying portion does not apply the force to the second casing located at the close position; and a controller configured to perform:

a judging processing in which the controller is configured to judge whether a tank mount state, which is a mount state of the tank with respect to the tank mount portion, is a middle-of-mounting state in which the tank is being mounted on the tank mount portion; and a switching processing in which the controller is configured to:

switch the state of the force-applying portion to the first state when the controller judges in the judging processing that the tank is in the middle-of-mounting state, and switch the state of the force-applying portion to the second state when the controller judges in the judging processing that the tank is not in the middle-of-mounting state.

2. The recording apparatus according to claim 1, wherein the tank mount portion is fixed to the second casing such that a tank mounting direction in which the tank is to be mounted on the tank mount portion coincides with a horizontal direction when the second casing is located at the close position and such that the tank mounting direction coincides with a direction having a vertically downward component when the second casing is located at the distant position.

3. The recording apparatus according to claim 1, further comprising a first sensor disposed on a downstream end of the tank mount portion in a tank mounting direction and configured to detect a contact of the first sensor with the tank, wherein the controller is configured to judge in the judging processing that the tank mount state is not in the middle-of-mounting state, in a state in which the first sensor is detecting the contact thereof with the tank.

4. The recording apparatus according to claim 3, further comprising:

a door configured to open and close an opening of the tank mount portion; and a second sensor configured to detect that the door is closed, wherein the controller is configured to judge in the judging processing that the tank mount state is the middle-of-mounting state, in a state in which the first sensor is not detecting the contact thereof with the tank and the second sensor is not detecting that the door is closed.

5. The recording apparatus according to claim 4, wherein the controller is configured to judge in the judging processing that the tank mount state is not in the middle-of-mounting state, in a state in which the first sensor is not detecting the contact thereof with the tank and the second sensor is detecting that the door is closed.

6. The recording apparatus according to claim 4, further comprising a display, wherein the controller is configured to perform a display control processing in which the controller is configured to control the display, and wherein the controller is configured to control the display in the display control processing to display thereon a message prompting closure of the door, in the state in which the first sensor is not detecting the contact thereof with the tank and the second sensor is not detecting that the door is closed.

7. The recording apparatus according to claim 5, further comprising a third sensor configured to detect an existence of at least a part of the tank in the tank mount portion, wherein the controller is configured to judge in the judging processing that the tank mount state is the middle-of-mounting state, in a state in which the first sensor is not detecting the contact thereof with the tank, the second sensor is not detecting that the door is closed, and the third sensor is detecting the existence of the at least the part of the tank, and wherein the controller is configured to judge in the judging processing that the tank mount state is not in the middle-of-mounting state, in a state in which the first sensor is not detecting the contact thereof with the tank, the second sensor is not detecting that the door is closed, and the third sensor is not detecting the existence of the at least the part of the tank.

8. The recording apparatus according to claim 1, further comprising:

a door configured to open and close an opening of the tank mount portion; and a second sensor configured to detect that the door is closed, wherein the controller is configured to judge in the judging processing that the tank mount state is the middle-of-mounting state, in a state in which the second sensor is not detecting that the door is closed.

9. The recording apparatus according to claim 1, further comprising:

a support portion configured to support the recording medium; and a recording portion configured to use the recording agent to record the image on the recording medium supported by the support portion, wherein the first casing is configured to support the support portion, and wherein the second casing is configured to support the recording portion such that the recording portion faces the support portion when the second casing is located at the close position.

10. A recording apparatus, comprising:

a first casing;

a second casing connected to the first casing with a shaft and pivotable about the shaft with respect to the first casing in a pivotal direction having a vertical component so as to be located at (i) a close position which is close to the first casing and at which an image is recorded on a recording medium and (ii) a distant position farther from the first casing than the close position;

a tank mount portion on which a tank storing a recording agent for recording the image on the recording medium is mountable, the tank mount portion being fixed to the second casing so as to be pivotable together with the second casing;

a force-applying portion configured to be switchable between a first state in which the force-applying portion applies a force to the second casing to limit the pivotal movement of the second casing located at the close position and a second state in which the force-applying portion does not apply the force to the second casing located at the close position; and a controller configured to perform:

a judging processing in which the controller is configured to judge whether a tank is being mounted on a mount position of the tank mount portion; and a switching processing in which the controller is configured to:

switch the force-applying portion to the first state when the controller judges in the judging processing that the tank is not mounted on the mount position of the tank mount portion, and switch the force-applying portion to switch the second state when the controller judges in the judging processing that the tank is mounted on the mount position of the tank mount portion.

* * * * *